United States Patent [19]

Babiol

[11] 4,093,095

[45] June 6, 1978

[54] STOPPER-COVERING CAPSULE FOR A BOTTLE

[75] Inventor: Pierre Babiol, Villefranche-sur-Saone, France

[73] Assignee: Societe Nouvelle de Bouchons Plastiques S.N.B.P., Paris, France

[21] Appl. No.: 771,129

[22] Filed: Feb. 23, 1977

[30] Foreign Application Priority Data

| | | |
|---|---|---|
| Feb. 27, 1976 | France | 76 06230 |
| Jul. 13, 1976 | France | 76 22021 |

[51] Int. Cl.[2] ..... B65D 41/18

[52] U.S. Cl. ..... 215/307; 215/320; 215/321; 215/341; 215/344; 215/277

[58] Field of Search ..... 215/317, 320, 321, 307, 215/277

[56] References Cited

U.S. PATENT DOCUMENTS

| | | | |
|---|---|---|---|
| 2,947,432 | 8/1960 | Marcel | 215/321 |
| 2,982,450 | 5/1961 | Whitton | 215/321 X |
| 3,247,993 | 4/1966 | Gelbjerg | 215/321 |
| 3,247,994 | 4/1966 | Fuglsang | 215/321 |
| 3,494,496 | 2/1970 | Livingstone | 215/320 |
| 3,696,957 | 10/1972 | Van Baarn | 215/321 X |
| 3,830,395 | 8/1974 | Crisci | 215/321 |

FOREIGN PATENT DOCUMENTS

| | | | |
|---|---|---|---|
| 1,209,083 | 9/1959 | France | 215/320 |
| 521,954 | 3/1955 | Italy | 215/320 |

*Primary Examiner*—Donald F. Norton
*Attorney, Agent, or Firm*—Dowell & Dowell

[57] ABSTRACT

The invention comprehends a capsule for stoppering the neck of a bottle, characterized in that its skirt has a cross section which is cylindrical practically over the whole of its vertical height, has a slight thickness, substantially uniform over the whole of its height, and includes around its inner wall, a retaining rib of triangular section intended to be anchored and fit beneath the collar on the neck of the bottle.

10 Claims, 7 Drawing Figures

STOPPER-COVERING CAPSULE FOR A BOTTLE

The present invention relates to capsules which are mounted on the necks of already stoppered bottles as an ornamental addition with a veiw to concealing the stopper and for guaranteeing, at least to a certain extent, that the bottle has not already been un-stoppered fraudulently since its initial filling.

Such capsules are known which, being made of an elastically deformable material, are focibly mounted on the bottle with the aid of a special spreading tool. Others are provided for shrinking onto the neck after having been mounted thereon in such a manner as to follow the shape of the profile exactly. It is likewise known to include in a capsule of the kind in question, an inner rib or other retaining device intended to anchor in some manner below a collar on the neck, however, these articles have a definite shape after moulding and do not accept such deformation forces which limits their application possibilities.

On the other hand, the invention aims to permit a very simple over-stopper capsule to be produced at an economic price and which may be mounted on the neck of the bottle by a simple pushing on at the press without any additional tools, except for a simple wetting of the collar before mounting.

In accordance with the invention, the skirt of the capsule is made with a cylindrical inner profile with an appropriately angled retaining rib destined to engage beneath the collar. Its thickness is very reduced and it is made with its base of an injection moulded plastics material having sufficient qualities enabling it to be elastically deformed. It includes upper apertures for the evacuation of air when it is mounted in place and which furthermore serve on the one hand as ventilation apertures for the upper surface of the stopper and when the latter is made of an organic material (cork), on the other hand as a support passage ensuring centering of the core of the mould during the injection phase against considerable forces which tend to decentre it and produce variations in the thickness of the wall of the moulded capsule.

Having regard to the cost of the stopper whatever its material may be, and the cost of inserting it, there is a considerable burden regarding the general cost of stoppering a bottle using a stopper and a capsule covering the stopper.

To overcome this disadvantage, the stopper is omitted and it is replaced by a very cheap element which is associated with the inner surface of the base of the capsule covering the stopper.

The accompanying drawing, given by way of example, will enable the invention, the features which it presents and the advantage which it is capable of obtaining, to be better understood.

Figure 1:
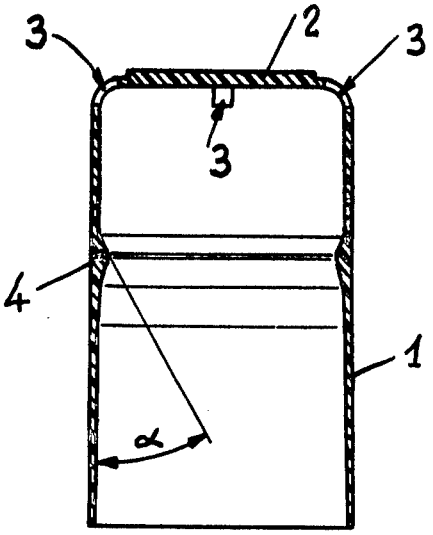
FIG. 1 is an axial section through an over-stoppering capsule in accordance with the invention.

The capsule shown in FIG. 1 is constituted by a cylindrical hollow member or skirt 1 closed at one of its ends by a base 2. Four apertures or notches 3 disposed at 90° to one another, are provided where the base and the skirt join. A retaining rib 4 in the form of a triangular flange is provided at a certain distance below the base 2 the upper oblique side of the triangle in section forming with the vertical base of the latter an angle, $\alpha$ determined in the manner which will be divulged hereinafter.

Away from the rib 4 the skirt 1 has a very slight and perfectly regular thickness. The base 2 is made a little thicker in its portion geometrically within the apertures 3.

The plastics material used has a density in the neighbourhood of 0.936 with a melt index gradient approximately equal to 2. It has good qualities enabling it to deform elastically.

Manufacture is produced by injection, the apertures 3 being provided by the retaining fingers which are for centering and supporting the free end of the core in such a manner that the latter cannot be displaced nor flexed under the effect of unequal forces which appear during the injection process. In that manner, any irregularity in thickness of the skirt 1 is prevented.

Figure 2:
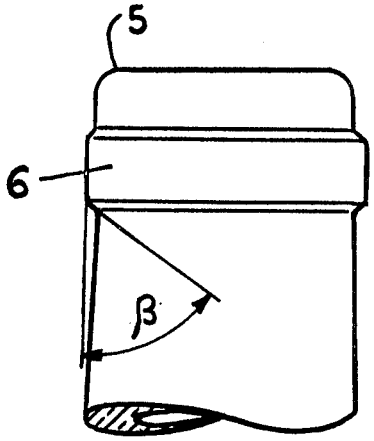
FIG. 2 is a view of the neck on which the capsule of FIG. 1 has to be mounted.

The capsule shown in FIG. 1 is intended to be mounted on a normal neck such as that of FIG. 2. A neck of this kind comprises an upper rounded rim 5 and a collar 6 having a flattened trapezoidal shape in section at a certain distance below the rim. The angle at the base of the trapezoid which is isosceles in section, is indicated by $\beta$.

Mounting is effected by a simple forcing on. The entrance to the skirt is first of all dilated to some extent on contact with the rim 5 and then to a much greater extent whilst sliding over the collar 6 the truncated upper surface of which acts as an inclined plane. Beyond the collar, the skirt is contracted by an elasticity effect. At the end of the forcing on, the base 2 comes to bear against the rim of the neck at the same time as the rib 4 is re-clamped against the truncated lower surface of the collar. At this moment, the rib is located within a zone where the outer surface of the skirt is inclined at an angle $\gamma$ with respect to the vertical whilst the upper surface of the rib produces, as indicated, the angle $\alpha$ with the said surface.

During moulding, the angle $\alpha$ is determined in such a manner that $\alpha + \gamma = \beta$. In these circumstances, the rib is perfectly anchored beneath the collar without any risk of untimely detachment.

As indicated above, the apertures 3 serve during the moulding for the passage of fingers for centering and retaining the core of the mould. During mounting, they ensure evacuation of air imprisoned between the skirt and the neck. Once the capsule has been mounted, they guarantee ventilation of the top of the stopper 7 of the bottle whilst also preventing the appearance of anaerobic molds.

Figure 3:
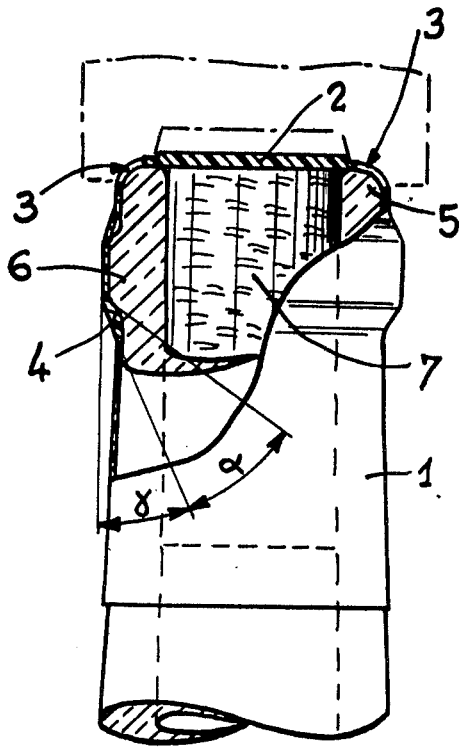
FIG. 3 is a side view in partial section showing the neck and capsule assembly after mounting of the capsule.
Figure 4:
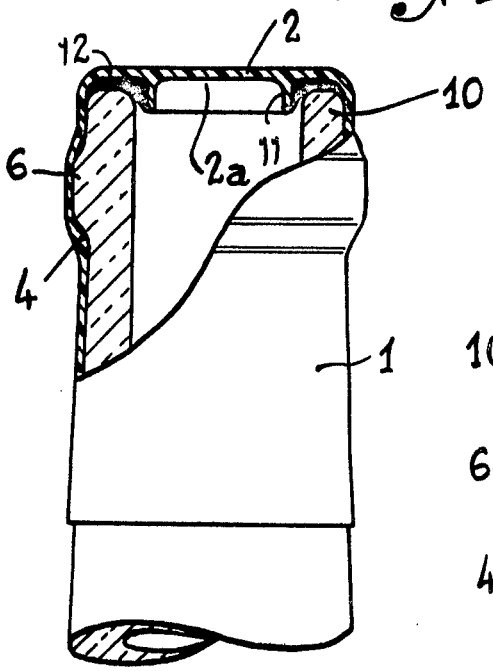
FIGS. 4 to 7 show different embodiments of a capsule produced in accordance with the invention and comprising a fluid-tight sealing element.

Variants of the capsule according to the present invention are represented in FIGS. 4 to 7. According to these variants, the apertures 3 represented in FIGS. 1 and 3 are omitted. As shown in FIG. 4, there is provided at the inner surface 2*a* of the base 2 of the capsule 1, a funnel 11 which, with the lateral portion or skirt of the capsule located at the level of the base 2, defines an annular space which is partially filled with a plastics material in such a manner that the latter forms an adhesive coating 12 which also covers the top of the inner surface of the skirt. When the capsule 1 is located in place, the funnel penetrates with clearance into the bore of the neck whilst the end of the latter deforms the coating 12 thus ensuring a good fluid-tightness at this level. It is to be noted that the coating 12 likewise cooperates with a portion of the periphery of the end of the neck so as to improve fluid-tightness still further. Of course, so that the said end penetrates slightly within the coating 12, it is necessary for the distance separating the rib 4 from the inner surface of the base 2 to be determined with precision.

Figure 5:
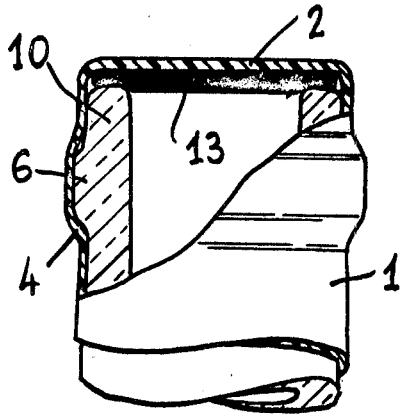

In the variant of FIG. 5, the inner surface of the base 2 of the capsule 1 is associated by some means with a gasket 13 normally used with stoppering capsules of the "crown" type. Such a well known gasket is produced with advantage by means of two aluminium foil washers between which is located in the form of a sandwich a disc of cork or of plastics material.

Here again the distance separating the rib 4 from the inner surface of the base 2 determines the degree with which the end of the neck is forced into the gasket 13 and consequently the fluid-tightness.

Figure 6:
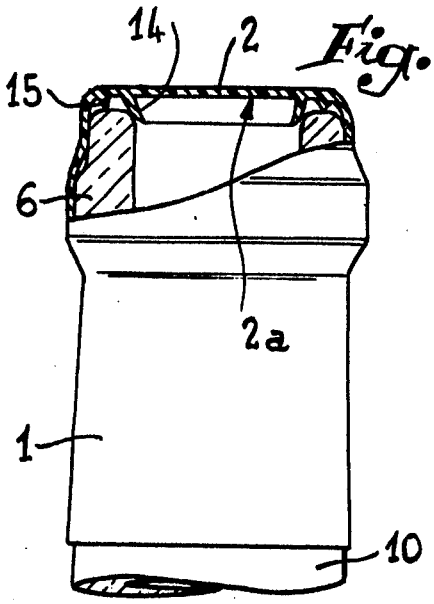

Another variant is illustrated in FIG. 6 in which the inner surface of the base 2 of the capsule 1 is provided with an annular lip 14 constituting a frustum of a cone converging towards the bottom and which, at the moment when the capsule is located in position, cooperates with the junction between the bore in the neck and its end so as to improve fluid-tightness. It will be noted that a rib 15 is provided on the inner surface of the base 2 in a manner concentric with the lip 14 and around the latter. This rib is for engaging against the end of the neck when the capsule is located in position so as to improve fluid-tightness.

Figure 7:
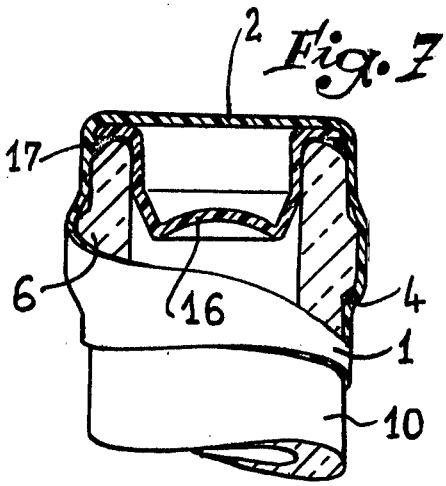

As shown in FIG. 7, the base of the capsule 2 is associated with a cup gasket 16 the margins of the flange of which are retained between a rib 17 integral with the inner wall of the skirt and the base of the said capsule. The gasket 13 provided in the embodiment of FIG. 5, may also be retained in the same manner.

Thus, there is provided in accordance with the above variants, a stoppering member of the stopper-covering type of capsule but which itself enables the closing of the neck of a bottle to be effected. Of course, the apertures 3 provided where the skirt joins the base, may be omitted without disadvantage since there is no longer any chance, as with a normal stopper covering capsule, of seeing that the stopper is forced into the neck at the instant when the said capsule is located in position.

I claim:

1. A deformable plastic capsule in combination with a bottle having a neck and having a bore extending into the bottle through an upper rim and having below the rim an enlarged annular collar which is trapezoidal in cross-sectional shape, the lower periphery of the collar being stepped inwardly at a first angle to the vertical to form an annular anchor surface, the capsule comprising:

a base portion shaped to overlie the rim of the bottle and cover its bore;

a thin-wall cylindrical skirt portion integrally joining the base portion, the skirt portion being of lesser diameter than the diameter of the bottle neck and conforming approximately with the shape of the bottle neck and collar when fitted thereon, and the skirt portion being of axial length greater than the distance between the rim and the anchor surface of the collar; and the skirt portion having an annular inwardly-extending retaining rib which is triangular in cross-section and extends around the inner surface of the skirt wall, the retaining rib being spaced from the base portion of the capsule and located to fit below the lower periphery of the collar against the anchor surface, the retaining rib having an upper-oblique surface which before the capsule is fitted to a bottle forms with the axial sidewall of the skirt portion a second angle, and the rib being so formed that after the capsule is fitted to a bottle the outer surface of the skirt will be inclined inwardly in the vicinity of the lower periphery of the collar at a third angle, the sum of the second and third angles equalling the first angle.

2. A capsule as set forth in claim 1, wherein the capsule has small apertures through it located where the base portion and the skirt portion join.

3. A capsule as set forth in claim 1, formed of injection molded plastic material wherein the plastic material has a density in the neighborhood of 0.936 with a melt index gradient of around 2.

4. A capsule as set forth in claim 1, wherein the base portion has an inner surface carrying stoppering means for engaging the rim of the bottle in fluid-tight engagement.

5. A capsule as set forth in claim 4, wherein said stoppering means comprises a tubular funnel attached to the base portion and extending into the bore of the bottle and an annular ring of deformable material disposed against the base portion and contacting the skirt portion and the funnel to abut the rim of the bottle when the capsule is anchored thereon by the retaining rib.

6. A capsule as set forth in claim 4, wherein said stoppering means comprises a gasket carried by the inner suface of the base portion and compressible against the rim of the bottle.

7. A capsule as set forth in claim 6, wherein said skirt has an annular rib member extending inwardly therearound between the base portion and the retaining rib, the annular rib member being located close to the base portion and contacting said gasket to hold it against the base portion.

8. a capsule as set forth in claim 4, wherein said stoppering means comprises a gasket carried by the inner surface of the base portion, and the gasket having a portion shaped to fit snugly into the bore of the bottle.

9. A capsule as set forth in claim 4, wherein said stoppering means comprises a conical annular lip integral with the base portion and extending inwardly to obliquely enter the bore and seal against the neck where the bore joins the rim of the bottle, and an annular rib integral with the base portion and extending inwardly between the lip and the skirt and shaped to seal against the rim of the bottle when the lip is in sealed position.

10. A capsule as set forth in claim 4, wherein the spacing between the inner surface of the base portion and the retaining rib on the skirt is such that the stoppering means is compressed and distorted when the capsule is anchored on the bottle neck by the retaining rib.

* * * * *